US008489230B2

(12) United States Patent
Engle

(10) Patent No.: US 8,489,230 B2
(45) Date of Patent: Jul. 16, 2013

(54) RECIRCULATING SORTING SYSTEM

(76) Inventor: Jonathan Engle, Auckland (NZ)

( * ) Notice: Subject to any disclaimer, the term of this patent is extended or adjusted under 35 U.S.C. 154(b) by 803 days.

(21) Appl. No.: 12/599,360

(22) PCT Filed: Mar. 7, 2008

(86) PCT No.: PCT/NZ2008/000047

§ 371 (c)(1),
(2), (4) Date: Nov. 9, 2009

(87) PCT Pub. No.: WO2008/108671

PCT Pub. Date: Sep. 12, 2008

(65) Prior Publication Data

US 2010/0152886 A1 Jun. 17, 2010

(30) Foreign Application Priority Data

Mar. 7, 2007 (NZ) ..... 553707

(51) Int. Cl.
*B07C 5/38* (2006.01)

(52) U.S. Cl.
USPC ..... 700/224; 700/223; 209/584; 209/900; 209/12.1

(58) Field of Classification Search
USPC ..... 700/223, 224; 209/583, 584, 900, 209/12.1
See application file for complete search history.

(56) References Cited

U.S. PATENT DOCUMENTS

| | | | | |
|---|---|---|---|---|
| 4,835,702 | A * | 5/1989 | Tanaka | 700/217 |
| 5,097,959 | A * | 3/1992 | Tilles et al. | 209/584 |
| 5,901,855 | A | 5/1999 | Uno et al. | |
| 7,967,149 | B2 * | 6/2011 | Helgi | 209/592 |
| 8,091,712 | B2 * | 1/2012 | Thorsson | 209/559 |
| 2004/0103107 | A1 | 5/2004 | Bradley et al. | |
| 2005/0125096 | A1 * | 6/2005 | Kechel | 700/224 |
| 2009/0000996 | A1 * | 1/2009 | Stemmle | 209/584 |
| 2009/0216368 | A1 * | 8/2009 | Thorsson | 700/219 |
| 2011/0029127 | A1 * | 2/2011 | Stemmle | 700/223 |
| 2011/0062257 | A1 * | 3/2011 | Gould et al. | 241/24.26 |
| 2011/0192770 | A1 * | 8/2011 | Goertz et al. | 209/592 |
| 2012/0018353 | A1 * | 1/2012 | McKenna et al. | 209/3.1 |

FOREIGN PATENT DOCUMENTS

EP 0666116 8/1995

OTHER PUBLICATIONS

International Search Report/ PCTNZ2008/000047/ Jul. 10, 2009.

* cited by examiner

*Primary Examiner* — Patrick Mackey
(74) *Attorney, Agent, or Firm* — Young & Thompson

(57) ABSTRACT

The apparatus is for sorting a range of machine-identifiable items received in random order such as meat products or cuts produced at an abattoir. In one example, the items are allocated into high, medium and low priority types (total 205 types). High priority items are allowed a smaller range of types than are low-priority items. Items are recirculated automatically for re-sorting once, twice or three times respectively into fully sorted sets of products. Preferably a freezing chamber surrounds the sorting apparatus so that the items become chilled or frozen while being sorted.

8 Claims, 2 Drawing Sheets

RECIRCULATING SORTING SYSTEM

FIELD

Figure 1:
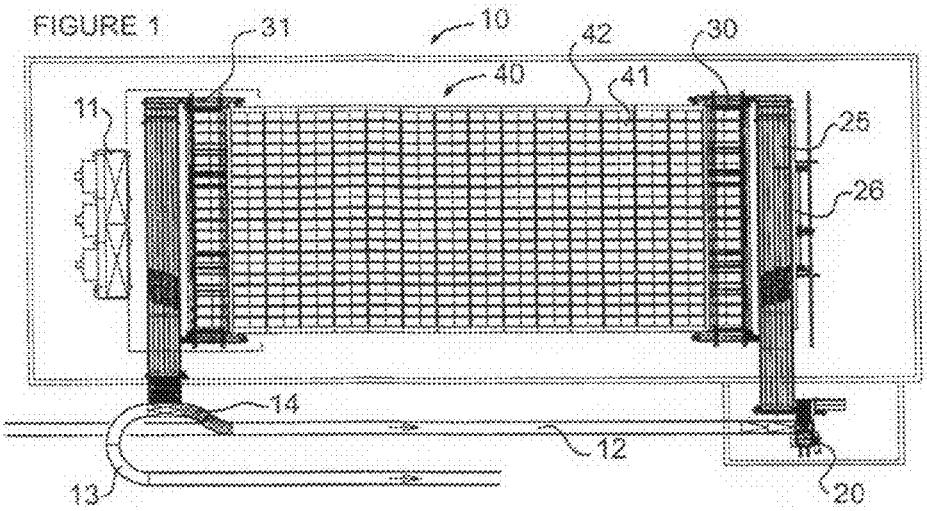

This invention relates to the field of sorting systems and apparatus, with particular application to systems for sorting extensive ranges of products received in a substantially random mix.

BACKGROUND

In general when packing products from a production line, one type of product is finished and delivered for packing at a time, and the packing, palletizing and delivery of a single type of product at a time can be relatively easily organised and managed. However, with products such as cut and packaged meat which is derived by processing a whole down into component parts, the number of different types of product delivered for freezing, chilling or other further processing may be very extensive, and these parts are all delivered up at essentially the same time in a substantially random order, requiring sorting.

Automated and manual systems are known for sorting meat cuts or other mixed and assorted products, where the products are identified with a barcoded label applied to each, and where each identified piece is transported to a designated tray or shelf in a racking system. The sorted products may be then palletized and transferred to a freezer or chiller, or more preferably the racking system itself is refrigerated, so that the sorted products are chilled or frozen, and maintained frozen, while stored.

PROBLEM TO BE SOLVED

Commonly, but not always, about 80% by quantity of the individual items derived from the processing of a carcass are of a few types, while the remaining 20% is made up of small numbers of very many different types of product. However the time and/or skill required for sorting each item by type is the same, regardless of priority or frequency, and the sorting, packing and delivery of high volume products is retarded by the time and/or skill expended on sorting the numerous low volume products.

Furthermore, when sorting and packaging meat products, it is desirable for the items to be chilled or frozen as quickly as possible after processing, with as little manual handling as possible to reduce the possibility of contamination, damage or human error. Accordingly it is desirable that the sorting process does not unnecessarily delay or interfere with the chilling or freezing process.

OBJECT

It is an object of this invention to provide means to more efficiently sort an extensive range of product types, or at least to provide the public with a useful choice.

STATEMENT OF INVENTION

In a first broad aspect the invention provides recirculating sorting apparatus wherein the apparatus includes:

a first or infeed conveyor capable of bringing identifiable items to sorting or recognition apparatus comprising part of a controlling computer system, capable of identifying said identifiable items and causing said identifiable items to be delivered by a first transfer means to a selected shelf of a first, smaller array of two or more sorting shelves thereby forming a set of at least partially sorted items on any one sorting shelf; a second, larger array of deep holding shelves having a combined width comprised of a plurality of shelves and a combined height comprised of a plurality of levels; second transfer means capable of transferring a set of at least one item from a selected sorting shelf to a selected holding shelf; and third transfer means capable of selectively carrying and delivering a set of at least one item from a selected holding shelf either to a second (outfeed) conveyor, or to a third (recirculating) conveyor capable of selectively recirculating said sets of items to the recognition apparatus, so that any set that is incompletely sorted after an earlier pass through the recirculating sorting apparatus becomes more completely sorted after a later pass.

Preferably any one sorting shelf of the first array is as long as the combined width of all shelves at any one level of the second array and the second transfer means includes means capable of lifting or lowering a selected shelf of the first array into alignment with and adjacent a selected level of the second array, so that when in use a selected set of at least one item or items may be transferred from a position along a sorting shelf and into a holding shelf.

Optionally any one sorting shelf of the first array is provided with means capable of horizontally moving the sorting shelf along the level of the second array so that any part of the sorting shelf may be aligned with a selected holding shelf of the second array.

Preferably the sorting shelves and the holding shelves are substantially the same size, and the array of holding shelves comprises a vertical rack having a plurality of levels, each level having a horizontal width equivalent to a multiple of said shelves, such that in use a level includes multiple holding shelves at one level, each shelf capable of holding a set of items received from a sorting shelf.

Preferably any one holding shelf of the second array has a finite depth or length so that when a selected set of at least one item is transferred into a first end of the holding shelf, other items already on the holding shelf are pushed towards a second end of the holding shelf, so that, when in use, items become accessible to the third transfer means.

Optionally each holding shelf contains guides or tracks or conveyor apparatus and optionally the conveyer apparatus may be activated under control of the controlling computer, so that the holding shelf can be emptied.

In a second broad aspect at least part of the rack of holding shelves is placed within temperature-moderating means, such that the temperature of the items is adjusted and/or moderated while held on said holding shelves.

In one option, the temperature-moderating means includes a refrigerated blower for cooling the items on the holding shelves and the whole recirculating sorting apparatus is contained within a chamber.

More preferably the temperature-moderating means includes a refrigerated blower for freezing the items on the holding shelves.

In a third broad aspect the invention provides a method for using recirculating sorting apparatus for sorting a range of items of different types, wherein the method includes the steps of:

(a) sorting the range into a number of sets less than or equal to a number of sorting locations, each set being refined to a degree of assortment according to a selection made from the following group {(i) a single type of item, (ii) a first degree of assortment comprising a number of types of item less than or equal to the number of sorting locations, (iii) a second degree of assortment comprising a number of types of item up to the square of the number of sorting locations, (iv) a third degree of assortment comprising a number of types of item up to the cube of the number of sorting locations, or (v) a subsequent degree of assortment comprising a number of types of item up to higher power of the number of sorting locations};

(b) transferring the sorted sets to holding locations;

(c) re-sorting each set from the holding location into plural sets with one lesser degree of assortment, until (d) sets are sorted to a desired degree of assortment; and removing the sorted sets.

Preferably the re-sorting is performed by the same method as used for the initial sorting and may be terminated when the number of items reallocated to a different holding shelf is zero.

In one option the apparatus operates in multiples of five: that is, five sets of a highest priority, at least one set of 25 of a medium priority, and one set of 125 of a lowest priority.

Accordingly the small or first array includes up to five said sorting shelves.

In a related aspect the invention provides that a limited number of items accorded a high priority become sorted in only one pass.

In another broad aspect the invention provides a method for using recirculating sorting apparatus for sorting a range of items of different types, wherein the method includes the steps of:

(a) initially sorting the range into a number of sets N-x (where N is a function of the number of sorting locations or shelves N), each set being sorted to a varying degree according to a sorting action selected from the following group {(i) a single type of item provided with a high priority, (ii) a first degree of assortment comprising a number of types of item less than or equal to the number N, (iii) a second degree of assortment comprising a number of types of item up to the square of the number N, (iv) a third degree of assortment comprising a number of types of item up to the cube of the number N, or (v) a subsequent degree of assortment comprising a number of types of item up to higher power of the number N};

(b) transferring the sorted sets to holding locations;

(c) re-sorting each set from the holding location into plural sets each more completely sorted, until (d) all sets are sorted to a desired extent; and removing the sorted sets.

In a related aspect the invention provides software suitable for use together with the apparatus: the software being capable when in use of causing the recirculating sorting apparatus to act within a selected one of a range of configurations; all of which make use of the physical layout of the apparatus in order that a particular sorting process may progress from a first, less completely sorted state into at least one later, more completely sorted state.

Preferably the configuration provides for N−1 separate high-priority items to be separated from an incoming stream; all the remainder being left in an unsorted group until after one or more recirculations through the recirculating sorting apparatus; where N is a function of the number of sorting shelves.

Alternatively, the configuration provides for N customer-directed collections of items; each collection being completely sorted after one or more recirculations through the recirculating sorting apparatus; where N is a function of the number of sorting shelves.

PREFERRED EMBODIMENT

The description of the invention to be provided herein is given purely by way of example and is not to be taken in any way as limiting the scope or extent of the invention.

Throughout this specification unless the text requires otherwise, the word "comprise" and variations such as "comprising" or "comprises" will be understood to imply the inclusion of a stated integer or step or group of integers or steps but not the exclusion of any other integer or step or group of integers or steps.

DRAWINGS

FIG. 1: shows a preferred embodiment of the recirculating sorting apparatus of this invention in plan (top) view.

Figure 2:
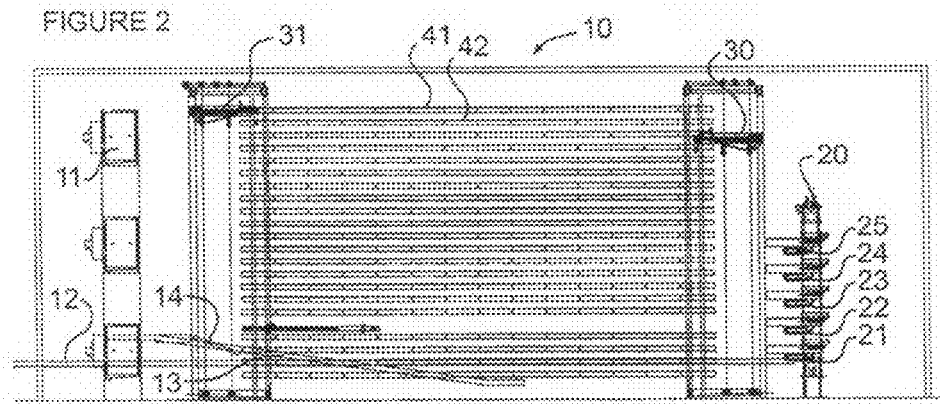

FIG. 2: shows a preferred embodiment of the invention in side view.

Figure 3:
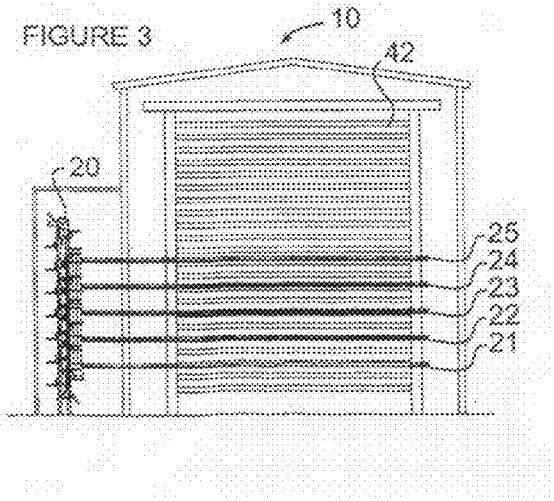

FIG. 3: shows a preferred embodiment of the invention in end view.

Figure 4:
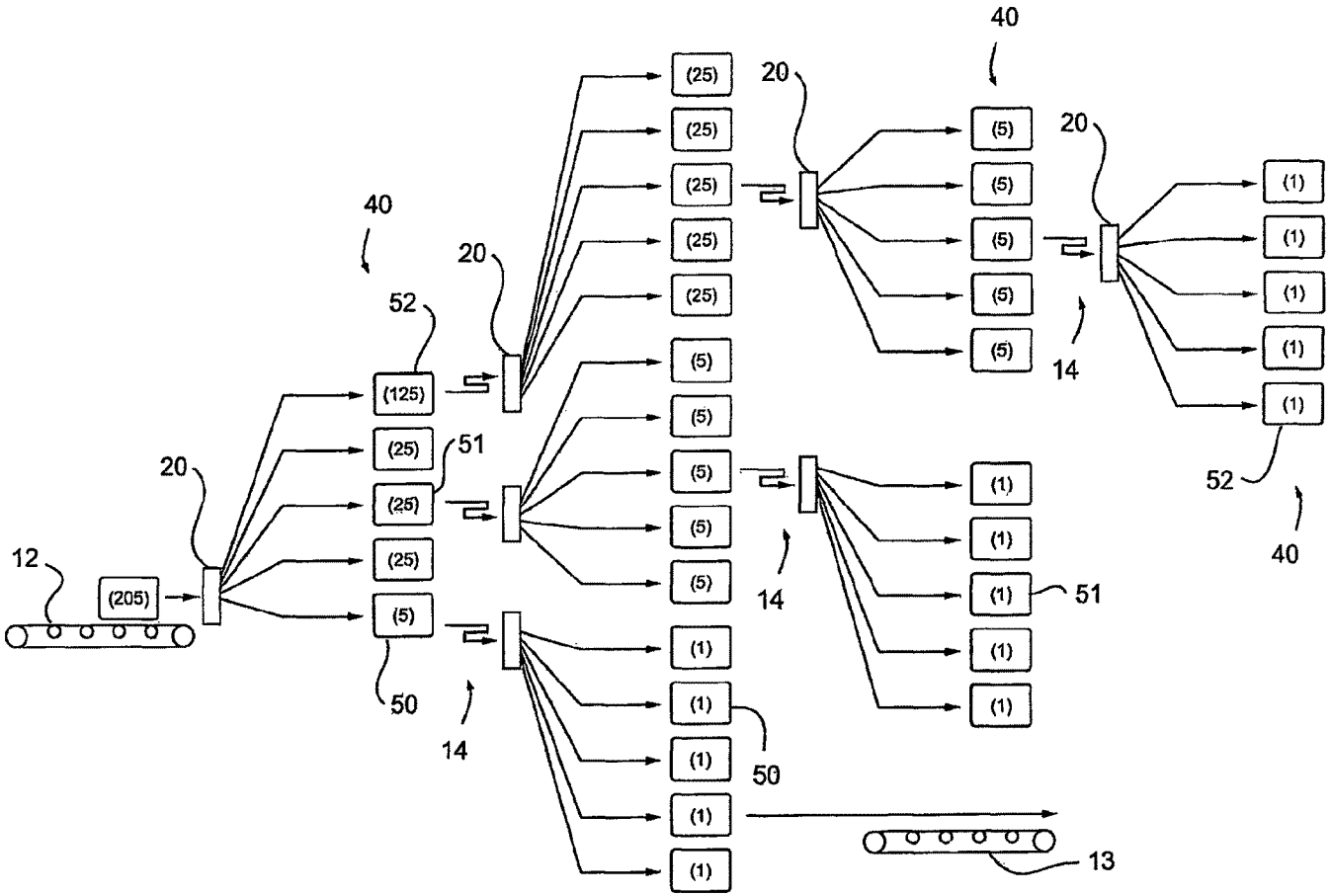

FIG. 4: is a diagram of a method for operation of this invention.

EXAMPLE 1

In an example preferred embodiment, the invention provides a system and apparatus for use at an abattoir for sorting cuts of meat at the stage of chilling or freezing, after they have been labelled by means of at least one of a range of machine-readable identifiers (such as weight, a barcode or RFID tag) and contained—such as by being wrapped or preferably boxed inside a carton in order that the barcode labels are presented to barcode readers in a consistent manner. This description shall assume use of a barcode as a suitable machine-readable identifier. The sorting process to be described is preferably fully automated, so that it can be performed at least in part in (for example) a blast-freezing environment where extreme temperatures preclude the involvement of human operators.

When a carcass is broken down, it may be processed into around two hundred different types of cut or product, each of which is identified by a unique barcode. These need to be sorted and collected for distribution, either as bulk lots entirely comprised of one type in each, or as a specific selection of a number of different types, depending on the requirements of a customer. The processed items arrive for sorting in a relatively random order with different types mixed together, so each item needs to be individually identified and transferred to the correct one of many sorting bins or shelves. While barcode labelling allows the different types to be readily and specifically identified, the subsequent process of sorting products is relatively slow and difficult simply because of the large number of different types of item to be dealt with, and the correspondingly large number of sort locations that are needed.

An associated problem is that the usual manual sorting process delays the commencement of chilling or freezing, thereby lowering the quality.

Some types of cut or product are much more numerous, and/or of a higher priority than others. This invention provides a means for automatically sorting those items from others of lesser priority, so that they can be dealt with quickly and efficiently, while the items of lesser priority are held for more complete sorting in downtime, whether overnight or concurrently, during slower periods of operation. In this example, the items are also being chilled or frozen inside freezing chamber 10 while being sorted and held, so as to avoid any delay and subsequent loss of quality. It will be evident to a reader skilled in the art that the recirculating sorting apparatus may be used without the chilling or freezing means for sorting and holding products that do not need to be chilled or frozen.

As shown in FIGS. 1 to 3 which depict the same apparatus from different aspects, the invention includes a rack of shelves 40 in a freezing chamber 10, with a set of refrigerated blowers 11 producing a relatively fast, cold airstream through the shelves to reduce the temperature of products on the shelving and freeze them. In a freezing chamber the temperature of the airflow may be between −52° C. and −28° C., whereas if the chamber is used just for chilling, the temperature may be −2° C. Products are brought into the apparatus on an infeed conveyor 12, and after sorting and perhaps storage (at least until freezing or chilling has been completed) are eventually removed for palletizing or packing on an outfeed conveyor 13. The process called sorting involves an item arriving at a recognition station, whereupon a computer (herein abbreviated to CPU) receives input from an item recognition device (such as a barcode reader) and causes an actuator to move the identified item into an an identified receptacle at a known position. That much is well-known to persons skilled in the art and will not be further described here. The CPU retains knowledge of where each item is located after it has been at least initially recognised and sorted into a defined place. By such a means, each identified receptacle (here, a "sorting shelf") comes to hold either one kind of items or groups comprised of known items.

The infeed conveyor 12 brings items to be sorted to a 5-way vertical distributor 20, where they are sorted onto one of five sorting shelves 21 to 25 arranged in a vertical array. The vertical distributor includes means to align items with hence deliver into any specific holding shelf. The sorting criteria are described in more detail below, whereby the items are divided into five categories, one per sorting shelf, with five high priority types of item on the shelf 21, twenty five medium priority types of item on each of three shelves 22 to 24, and up to 125 low priority types of item on the shelf 25. The items on a given shelf, for example the five types of item on shelf 21, are still randomly mixed and are arranged simply in the order they arrived, but they are distinguished and separated from all the other types of item which are allocated to different shelves. The number of each type of item on a given shelf may vary, depending on the rate at which items of each type are produced. The 5-way vertical distributor 20 is able to operate quickly and efficiently, because while it needs to identify and handle each item individually, it needs only to distribute them to five different locations in a simple vertical array. Accordingly the vertical distributor 20 is able to keep pace with the rate of arrival of items on the infeed conveyor 12. Final sorting of many items may take place later.

When a shelf 21 to 25 is full, a carton pusher 26 shunts the items on to a holding shelf 41 on an elevator 30, which in turn slides the loaded shelf 41 into a selected level 42 in the rack 40. The rack of shelves 40 may comprise any number of levels 42 from about 12 up to 30 or more, depending on the scale of the operation, and each level carries a horizontal array of shelves 41, so that when a set of items on a shelf 41 is pushed in at a level 42, it shunts preceding sets further back into the holding shelf. A CPU (not shown) keeps track of the sets of items on the shelves 41. Different levels typically receive different priority rated items.

Thus different levels 42 in the rack 40 of holding shelves are accordingly stocked with different sets or sub-assortments of items, ranging from a mix of just five types taken from sorting shelf 21, through to mixes of 125 types taken from sorting shelf 25. During downtimes such as when a small rate of product is arriving on the infeed conveyor 12, shelves 41 holding sets of items are taken off the back end of the levels 42 by an outfeed elevator 31, and the sets of items are transported to a return conveyor 14, which deposits the set back on the infeed conveyor 12. (The return conveyer would usually be included within the chilled environment of chamber 10). Although a sorting apparatus may rely on pushing by carton pusher 26 being carried right though the holding shelf, it may be preferable to extract the contents by an active means such as a driven conveyor within each shelf (or some of them).

The sets of items arriving back at the 5-way vertical distributor 20 via the return conveyor 14 are already sorted to some extent, and comprise a mix of just 5, 25, or 125 types of item depending on which sorting shelf they have come from. If the set comprises 125 different types of item (having come from lowest-priority sorting shelf 25), the 5-way vertical distributor sorts them into five sets of 25 types each, and each of these sets is then transferred to a shelf 41 as the sorting shelves are filled. If the set comprises 25 different types of item, the vertical distributor 20 similarly splits it into 5 sets of 5 types each which are again returned to the shelves 41. If the set is comprised of just five types of item (having either come from the sorting shelf 21, or having already made one or more passes through the system), the vertical distributor 20 is able to sort it into five sets, each comprised of a single type of item, and the sorting is then complete. The CPU will be aware of this condition.

The method of the system is illustrated schematically in FIG. 4. FIG. 4 is best viewed so that the infeed conveyor 12 is located at the left. The four vertical rows of boxes shown represent the first, second, third and fourth sortings respectively. The arrows between the second; third and fourth sortings that have a forwards, backwards and then forwards shaft represent recirculation and involve use of return conveyor 14.

If there are 5 sorting shelves, an assortment of up to 205 (5+25*3+125) types of item may be expected to arrive on the infeed conveyor 12. This is sorted by the 5-way vertical distributor 20 into five sets, having a mix of 5 items (high priority items 50), 3 lots of 25 items (medium priority items 51) or one lot of 125 items (low priority items 52), which are put on the rack of holding shelves 40. During downtime or during relatively quiet periods the outfeed elevator and return conveyor 14 returns these sets to the 5-way vertical distributor 20, to be sorted again. After the second sorting, the high priority items are already sorted into individual types of items, and can be removed from the system on the outfeed conveyor 13. The medium priority items are now sorted into sets of five, and the low priority items into sets of twenty five types of item. Again these sets are returned to the 5-way vertical distributor 20. After a third sorting, the medium priority items 51 are also sorted into individual types of item, and can also be removed from the system. The low priority items 52, now in sets of 5 types of item, return for a fourth and final sort whereby they also are divided into individual types of item and can be removed from the system. Storage can be regarded as a "first-in, first-out" system in that cartons on the holding shelves are pushed out by the arrival of further cartons of the same group or type. A mechanical means to clear a less-than-full holding shelf may be provided.

Thus high priority items, which are segregated into a set of just 5 types when first brought to the vertical distributor 20, make only one loop through the system before being completely sorted into individual types of item. They can then be drawn off the back end of the shelves 41 by the outfeed elevator 31, and removed by the outfeed conveyor 13 for palletizing or packing in a container for transport. These items are produced in relatively high quantities, and accordingly the shelves are filled and cleared relatively rapidly, and the sorting time for these items is minimised.

Medium priority items, which are segregated into a set of 25 types when first brought to the vertical distributor 20, make two loops through the system before being completely sorted into individual types of item.

Low priority items, which are segregated into a set of 125 types when first brought to the vertical distributor 20, make three loops (four sorting passes) through the system before being completely sorted into individual types of item. However there are less shelves of these products in the system, so in any case they can be processed fairly quickly.

The items are refrigerated while on the rack of shelves 40 and on the sorting shelves 21 to 25, and may also be chilled or refrigerated on the infeed conveyor and/or vertical distributor 20 if necessary. The sorting process therefore does not delay chilling or freezing of the items, regardless of individual priority.

It will be appreciated that the designation of a particular sorting shelf; whether receiving 125 types of item, 25 or just 5 types can be switched and changed to suit the particular mix of products received from the infeed conveyor 12, and in particular will change when receiving an already partially sorted set via the return conveyor 14. Because all items are barcoded, the sets can easily be tracked throughout the sorting process, and the sorting regime adjusted set by set to suit. Similarly, a given holding shelf could be switched to hold a different set of items, or hold various different sets of items at once, so long as the CPU retains "knowledge" of the different items along the holding shelf.

EXAMPLE 2

In this example, cited in order to emphasise the possibility of reconfiguring the apparatus by software for other purposes, a preferred "soft" configuration termed a "bucket sort" comprises reserving the sorting shelves 21, 22, 23 and 24 (cf FIG. 2) for four particular kinds of item, and putting all the other incoming items onto shelf 25 for subsequent sorting at a later time. By "soft" configuration we mean that the changed mode is a matter of adopting a changed software configuration, rather than making changes to the hardware. More generally this configuration provides for N−1 separate high-priority items to be separated from an incoming stream; all the remainder being left in an unsorted group until after one or more recirculations through the recirculating sorting apparatus; where N is a function of the number of sorting shelves (that need not be 5; if could be from 2 to 10 or more).

EXAMPLE 3

This example is also cited in order to emphasise the possibility of reconfiguring the apparatus for other purposes. Another preferred "soft" configuration is intended to best serve the needs of a customer who wants to receive an order made up of specified items, preferably arranged with like items close to each other. In this configuration, the sorting shelve 21. 25 (see FIG. 2) are each reserved for a particular customer and every item required is simply put on that customer's reserved shelf in the first pass, because that is speedy and allows the sorting apparatus to keep up with incoming items. During quiet periods (as previously explained) the unsorted material for any one customer is sorted out by recirculation, so that like items are adjacent. Note for all Examples that the apparatus is not limited to N=five sorting shelves only: preferably there is a range of between 2 and 10 shelves, or more.

VARIATIONS:

It will be appreciated that a wide variety of alterations could be made to the apparatus as described, above, while remaining within the general spirit and scope of the invention.

The assumption that various items have different priorities facilitates the organisation of the method of operation, but it will operate even if all items have the same priority. Conferment of a high priority on a limited number of items has the effect that these items are sure to be sorted most quickly, even without a "downtime" or "low throughput" condition.

As illustrated in Examples 2 and 3, it will be appreciated that one or more extremely high priority items could be sorted individually onto one or more sorting shelves 21 to 25, while other items are sorted into sets as described above. These extremely high priority items would thereby be entirely sorted out from first entering the rack 40, and could be taken directly to the outfeed conveyor 13 after chilling or freezing, without returning to the system via the return conveyor 14.

The number of items in a set composed on the sorting shelves 21 to 25 is preferably a multiple of the number of levels in the vertical distributor, ie: in the case of a 5-way distributor as described above, the preferred numbers of items in a set are 5, 25 (5 squared) or 125 (5 cubed). This allows the maximum value to be achieved by each pass through the system. It will be appreciated that if a 4-way distributor were to be used, it would be more efficient to have sets of 4, 16 and 64 types of item, and that if a 3-way distributor were to be used, higher powers of 3 might also be employed, ie: sets of 3, 9, 27 and 81 types of item, with the latter passing a further time through the system to be fully sorted. Typical abattoir requirements are to have about 205 categories. While a 5-way distributor is currently preferred and has been described in the accompanying text, 3, 4 or 6-way distributors, or other distribution systems might equally be employed to suit different operations. For example, a set of gated parallel horizontal conveyors could be used at the infeed to initially sort the incoming items into different sets.

While the system as described above is used for sorting items into final sets of one type each, it will be appreciated that the same sorting system could be used to make up shelves with a specific combination of items to suit a particular customer's requirements. The items could be sorted down to individual types and then recombined in the appropriate proportions to make up a specific composition on a shelf, or alternatively the set of types required by a particular customer could be sorted onto a given sorting shelf as they arrive, and then that set re-sorted to distinguish and quantify the individual items, and put an appropriate number of each on a shelf-space designated for that customer. Other such modifications to the system could also be made.

While the system as described is particularly suited to application in the freezer or chiller section of a meatworks, it will be appreciated that the same system could be applied to other industrial processing such as cooking or drying operations. Equally it could be applied to sorting meat products after freezing, for example in the transfer to a cold storage facility.

In case optical reading systems such as barcode systems are rendered inoperable by frost, other methods such as RFID tags may be used. Usually, the internal environment of the freezing chamber is too dry for condensation. Alternatively, identification may be made solely by weight, by shape, or by colour for example, without a preceding labelling stage.

ADVANTAGES

The items being sorted may be actively chilled or frozen during the first and later sorting procedures—so that the items become properly chilled as soon as possible after arrival.

Human health and safety are not endangered for the sake of an early start to chilling or freezing.

The sorting procedures are automatic and are carried out using bar-code information and computer/robotic activities without human intervention. It may be carried out during arrival of incoming goods, or delayed until that arrival has (at least for a while) ceased.

The sorting process does not interfere with the typical variable arrival of incoming items.

At the process end-point, the invention is capable of supplying either fully sorted or mixed, customised orders along the outfeed conveyer directly to either a palletiser, container, awaiting truck or other predetermined end point.

The size and arrangement of the various components could be altered considerably within the general spirit of the invention.

Finally, it will be understood that the scope of this invention as described by way of example and/or illustrated herein is not limited to the specified embodiments. Where in the foregoing description, reference has been made to specific components or integers of the invention having known equivalents, then such equivalents are included as if individually set forth. Those of skill will appreciate that various modifications, additions, known equivalents, and substitutions are possible without departing from the scope and spirit of the invention as set forth in the following claims.

I claim:

1. A recirculating sorting apparatus, comprising:

a first or infeed conveyor capable of bringing identifiable items to a recognition apparatus comprising a part of a controlling computer system that is capable of identifying said identifiable items and causing said identifiable items to be delivered by a first transfer means to a selected shelf of a first, smaller array of at least two sorting shelves thereby fanning a set of at least partially sorted items on any one sorting shelf;

a second, larger array of deep holding shelves having a combined width comprised of a plurality of shelves and a combined height comprised of a plurality of levels;

second transfer means capable of transferring a set of at least one item from a selected sorting shelf to a selected holding shelf; and third transfer means capable of selectively carrying and delivering a set of at least one item from a selected holding shelf either to a second outfeed conveyor, or to a third recirculating conveyor capable of selectively recirculating said sets of items to the recognition apparatus, so that any set that is incompletely sorted after an earlier pass through the recirculating sorting apparatus becomes more completely sorted after a later pass.

2. The apparatus as claimed in claim 1, wherein any one sorting shelf of the shelves of the first array is as long as a combined width of all shelves at one level of the second array and the second transfer means includes means capable of lifting or lowering any one selected shelf of the first array into alignment with and adjacent a selected level of the second array, so that when in use a selected set of at least one item or items is transferred from a part along a sorting shelf and into a holding shelf.

3. The apparatus as claimed in claim 1, wherein any one sorting shelf of the shelves of the first array includes means capable of horizontally moving the sorting shelf along the level of the second array so that any part of the sorting shelf may be aligned with a selected holding shelf of the second array.

4. The apparatus as claimed in claim 2, wherein any one holding shelf has a finite depth or length so that when a selected set of at least one item or items is transferred into a first end of a holding shelf, other items already on the holding shelf are pushed towards a second end of the holding shelf, so that when in use items become accessible to the third transfer means.

5. The apparatus as claimed in claim 4, wherein a rack of holding shelves is placed within temperature-moderating means, such that the temperature of the items is adjusted and/or moderated while held on said holding shelves.

6. The apparatus as claimed in claim 5, wherein the temperature-moderating means includes a chamber holding the recirculating sorting apparatus and a refrigerated blower capable of chilling the items on the holding shelves.

7. The apparatus as claimed in claim 6, wherein the refrigerated blower is capable of freezing the items on the holding shelves.

8. The apparatus as claimed in claim 1, wherein the first array of sorting shelves includes from two to at least ten sorting shelves.

* * * * *

UNITED STATES PATENT AND TRADEMARK OFFICE

CERTIFICATE OF CORRECTION

PATENT NO. : 8,489,230 B2
APPLICATION NO. : 12/599360
DATED : July 16, 2013
INVENTOR(S) : Jonathan Engle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 867 days.

Signed and Sealed this
Eighth Day of September, 2015

Michelle K. Lee

Michelle K. Lee
*Director of the United States Patent and Trademark Office*